US005937796A

United States Patent [19]

Sebastiani

[11] Patent Number: 5,937,796

[45] Date of Patent: Aug. 17, 1999

[54] GAS APPARATUS FOR HEATING FLUIDS

[75] Inventor: Enrico Sebastiani, Milan, Italy

[73] Assignee: Worgas Bruciatori, S.r.l, Modena, Italy

[21] Appl. No.: 08/733,070

[22] Filed: Oct. 16, 1996

[30] Foreign Application Priority Data

Oct. 17, 1995 [IT] Italy ..... MI95A2134 U

[51] Int. Cl.[6] ..... F22B 5/00

[52] U.S. Cl. ..... 122/13.1; 122/14; 122/17; 126/39 E; 431/351

[58] Field of Search ..... 122/13.1, 17, 14; 431/266, 10, 351; 126/39 E

[56] References Cited

U.S. PATENT DOCUMENTS

| | | | |
|---|---|---|---|
| 4,480,988 | 11/1984 | Okabayashi et al. | 431/329 |
| 4,510,890 | 4/1985 | Cowan | 122/17 |
| 4,565,523 | 1/1986 | Berkelder | 126/39 E |
| 5,317,992 | 6/1994 | Joyce | 122/14 |
| 5,335,646 | 8/1994 | Katchka | 122/17 |
| 5,355,841 | 10/1994 | Moore, Jr. et al. | 122/17 |
| 5,405,263 | 4/1995 | Gerdes et al. | 126/39 E |
| 5,494,003 | 2/1996 | Bartz et al. | 122/17 |
| 5,511,516 | 4/1996 | Moore, Jr. et al. | 122/17 |
| 5,649,822 | 7/1997 | Gertler et al. | 126/39 E |
| 5,797,355 | 8/1998 | Bourke et al. . | |

FOREIGN PATENT DOCUMENTS

| | | |
|---|---|---|
| 2130964 | 8/1994 | Canada . |
| 2033452 | 11/1970 | France . |

*Primary Examiner*—Teresa Walberg
*Assistant Examiner*—Jiping Lu
*Attorney, Agent, or Firm*—Morgan & Finnegan, L.L.P.

[57] ABSTRACT

The invention relates to an apparatus for heating fluids which includes a combustion chamber (20) in which the head (21*c*) of the burner with the burner openings (39) for the flames is juxtaposed with a wall (21*a*, 21*b*) of the chamber itself separating this latter from the lower portion of the apparatus; in the event of flammable substances being present in the environment surrounding the apparatus, these can enter the combustion chamber only through the openings (39) and the similar slots (50) formed in the wall (21*a*, 21*b*). This enables the ignition element (25) to ignite these substances as soon as they enter the chamber (20), thus preventing the formation of unwanted explosive or flammable mixtures in the chamber (20) and thereby contributing to the safety of the apparatus.

35 Claims, 6 Drawing Sheets

III
III
1
3
4
5
6
8
9
10
11
12
20
21
21a
21b
21c
21d
22
23
25
28
33
34
35
36
37
38
39
40
41
50
70
L

GAS APPARATUS FOR HEATING FLUIDS

FIELD OF THE INVENTION

The present invention relates to a convective heat transfer, gas fired apparatus having a substantially sealed combustion chamber and discharges products of combustion to the environment through at least one duct so arranged to produce an atmospheric to a sub atmospheric pressure in the combustion chamber. The combustion chamber includes at least one atmospheric premix burner which is operated under natural draft conditions and avoids flash back problems.

More specifically the present invention relates to a convective fluid heating device that includes a sealed combustion chamber operating under natural draft conditions with at least one premix burner with a diffuser having flame openings positioned in a wall of the diffuser which are designed to avoid flash back problems which result from surrounding volatile vapors.

BACKGROUND OF THE INVENTION

Fluid-heating appliances, lacking a sealed combustion chamber and their operation under natural draft conditions, are well known. Consumer demand and governmental regulations also require that these appliances be designed for maximum safety, especially since their use occurs in locations where the surrounding environment contains volatile and flammable substances. This frequently occurs in some countries, including the United States, where fluid heating appliances are installed in basements, garages or other areas which also serve to store fuel, paints, organic solvents, or any other flammable substances. Should any of these flammable substance be spilled, for any reason, the resulting vapors could surround the heating appliance, creating an obvious risk, such as a fire or an explosion.

In fact, such flammable vapors when combined with air produce an explosive or highly flammable mixture, which if it should reach the combustion chamber of a gas fired heating appliance, could be ignited by the pilot burner flame or by the main burner of the gas fired appliance when it is lit. The damaging consequences of an explosion are obvious. Should this flammable mixture be ignited in the combustion chamber, the flame would spread to the spilled flammable liquid and to the containers thereof, threatening to set fire to the house.

The risk of flammable vapors being introduced into the combustion chamber of a gas fired appliance is greatly increased when a storage tank is associated with the appliance. For example, the hot water held in the tank of such an appliance is exchanging heat with the air in the exhaust duct and may heat it so as to create a "chimney effect" in the duct even when the burner is off. As a result of this, flammable vapors in the environment surrounding the appliance would be sucked into the combustion chamber with all the unfortunate consequences described above.

Several existing heating devices attempt to satisfy the aforesaid demand for greater safety and avoid the risks just described. These include appliances which prevent fluid from being exchanged with the surrounding environment, i.e. where air is drawn in, and exhausts are expelled, through pipes passing in the walls of the room and communicating with the outside. However, the main disadvantage of these designs is that such an apparatus requires structural modifications to the gas appliances which significantly increase their cost. The appliance must be air-tight and, in order to evacuate exhausts and draw in air, a fan or blower must generally be installed.

Other known systems include that described in U.S. Pat. No. 5,317,992 to Joyce which illustrates a gas heater where combustion occurs at or near the combustion surface which is maintained at sub atmospheric pressure. The Joyce patent uses a surface burner in a sealed combustion chamber under natural draft. However, the burner design of the Joyce patent, does not solve or avoid flashback problems, such as the ignition of flammable vapors from the surrounding environment. In the Joyce patent, when the main burner is on, the combustion surface which is in contact with the flame reaches high enough temperatures to ignite the fuel-air-flammable vapors mixtures at the external side of said combustion surface and the flame, as is explained in U.S. Pat. No. 4,480,988. However, because of the low transit velocity in the system, the generated flame would spread to the spilled flammable liquid and to the containers thereof, threatening to set fire to the house.

Moreover, the combustion surface of the surface burners is designed to be wide in dimension to keep the combustion loading in the range from about 500 to about 2000 MJoules/$m^2$ hr. Typically the materials used to manufacture combustion surface of these "surface burner, are made of wire, preferably in Inconel 601, or ceramic, to withstand these high temperatures. As a result, these surface burners are more difficult and costly to manufacture as compared to aluminized-steel sheet burners that are utilized in the usual burners for water heater.

SUMMARY OF THE INVENTION

The present invention provides a gas appliance for: heating water in a water storage tank; instantaneous production of hot water; combination boilers; and hot air furnaces, that operate under similar principles. The appliance of the present invention heats fluids in a safe manner, even when used in an environment containing volatile combustible substances and avoids the disadvantages which limit prior art appliances, such as flashback. At the same time, the present invention reduces emissions of oxides of nitrogen ($NO_x$), and carbon monoxide (CO).

The gas apparatus of the present invention operates predominantly by convective heat transfer to heat fluids. The apparatus operates under natural draft, i.e., without the assistance of a fan, with at least one atmospheric premix burner. By definition the appliances of the present invention can be used to heat water exclusively for sanitary use (also commonly called boilers or water heaters), for producing hot water for sanitary use, for heating rooms (so-called combination boilers), and for generating hot air (known by the American term "furnaces").

The burner of the present invention has a flame that is detached from the upper surface head of the burner, as compared to the surface burners of the prior art discussed above where the flame occurs at or immediately adjacent the burner surface. Surfaces burners demand a surface material that can withstand extreme temperature conditions. The premix burner of the present invention does not need these expensive wire or ceramic materials because the flame does not occur on the surface thereof. At least one of the premix burners that is positioned in the combustion chamber of the present invention is associated with an air-fuel supply means for receiving a flow of gaseous fuel from a source thereof and operating in response to the flow of fuel to aspirate and combine a primary air component, from the environment, to form a combustible air fuel mixture for delivery to flame openings of the premix burner in a mixing chamber at a plenum total pressure. The primary air component is largely greater than that required for stoichiometrical combustion, if no secondary air is supplied.

The combustion chamber is sealed with a wall of various forms, a part of this wall is defined by the side of the burner mixing chamber where the flame openings are located. The sealing wall prevents the introduction of secondary air, apart from the openings in case provided for this objective. All the openings, those through which the fuel/primary air flame mixture flows and secondary air openings, if present, are located in the sealing wall of the combustion system.

The combustion chamber includes at least one discharge duct for products of combustion received from the burner. Each of the discharge ducts is in fluid communication with the environment to which the combustion products are exhausted and is arranged to produce from a substantially atmospheric to a sub atmospheric pressure in the combustion chamber following the embodiments and the circumstances, that in response to the flow into the environment of the products of combustion, or of the hot air between heating cycles. The sub atmospheric pressure, if available, co-operates with the plenum pressure in the mixing chamber of the burner to cause the air/gas or air/gas/vapors mixture to flow through the flame openings and, in case it is provided, to cause the secondary air, or secondary air/vapors, to flow through the specific secondary air openings.

The flame openings, plus secondary air openings, when provided, located in the sealing wall of combustion chamber have a total surface to obtain an average transit speed, of air or mixtures, above 0.5 m/sec. In some applications, it is beneficial if the surface of the secondary air openings does exceed 50% of the total surface of all the openings. The flame openings are all formed with a width/depth ratio that is designed to avoid the risk of flash back, even for stoichiometrical mixtures. The openings closely coupled to assure the cross ignition in any operating condition.

In the present invention, any fuel mixture, such as, air-fuel, air-fuel-flammable vapors, air-flammable vapors exiting in the combustion chamber, are immediately ignited from at least one specific device. The exit velocity of these mixtures from the openings in the premix burner are such that the flames are detached from the sealing wall of combustion chamber where the openings are located. As a result the temperature of the wall never reaches the value necessary to ignite any mixture on the other side from which the fuel/air mixture originates.

In case of a fully premixed burner (only flame openings on the sealing wall), the flame, without specific flame-holding methods, will lift due to the high velocity of the mixture exiting from the flame openings and to the low combustion velocity. To stabilize the flame under various operating conditions, different methods are used in the embodiments described hereafter.

BRIEF DESCRIPTION OF THE DRAWINGS

In order to better understand the invention, its characteristics and the advantages it provides, a few embodiments thereof are described hereinafter, by way of non limitative example and with the assistance of the appended drawings, in which.

DETAILED DESCRIPTION OF THE INVENTION

Figures 1, 2:
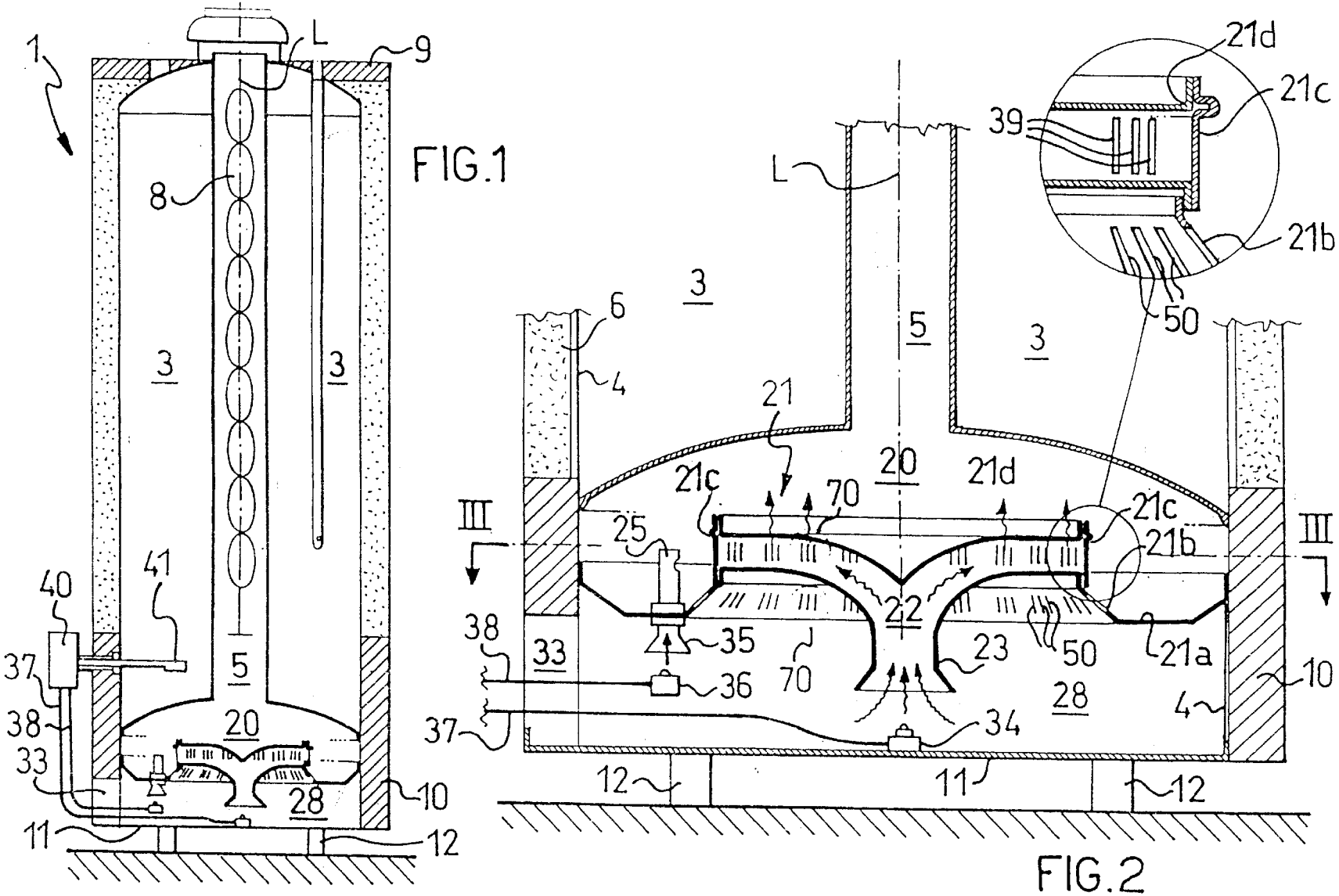
FIG. 1 is a longitudinal section of a gas appliance for heating fluids according to the invention.
FIG. 2 is an enlargement of a detail of FIG. 1.

With reference to the FIGS. 1–10, appliance 1 is of the free-standing type, that is it can rest on the floor or on another surface. Appliance 1 includes a combustion chamber 20 and at least one upstanding exhaust duct 5 about an axis L. The appliance or apparatus 1 includes a hot water storage tank 3 surrounding the exhaust duct 5 for exchanging heat therewith. Although in this preferred embodiment appliance 1 is used for heating water, it is clear from the foregoing, that appliance 1 may also be used for heating other fluids, such as air. When air is to be heated, the dimensioning of the heat exchanging surface for transferring heat to the air is altered, without modifying anything other features of the invention.

Appliance 1 includes tank 3 which has an outer shell 4, thermal insulation layer 6, such as insulating foam or other material, which is covered by an outer sheet material, e.g., metal (not shown). A baffle 8 is arranged in the duct 5 for agitating exhaust, e.g., products of combustion, rising through the duct 5 and enhancing the exchange of heat between these exhausts and the fluid in the tank 3.

The appliance 1 has a fibre-glass lid 9 and the bottom 10 of the insulating shell is made of the same material. At the bottom of the appliance, the shell is sealed to a base 11 so as to be airtight. The base 11 has a series of feet 12 for resting the appliance on the floor.

The bottom portion of the tank 3, from which the duct 5 extends, is domed and defines the ceiling of a combustion chamber 20 having the shape of a substantially spherical cap. Chamber 20 is closed at the bottom, that is the side opposite to the domed cap, with reference to the upward path of the exhausts, by a wall 21 having a composite profile (see FIG. 2) formed by sections with different functions which will now be described in detail.

Figure 3:
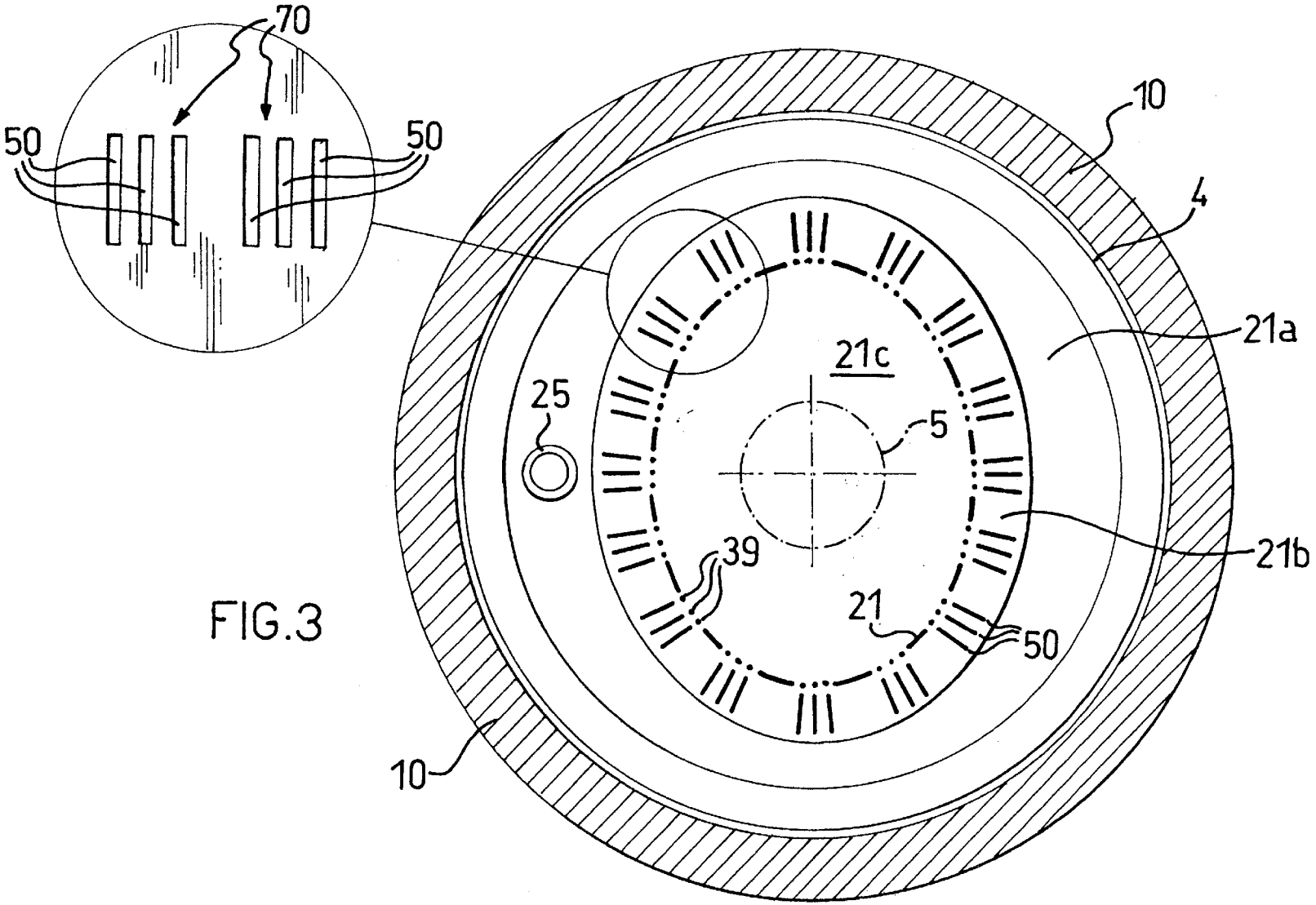
FIG. 3 is a sectioned view of the appliance of FIGS. 1 and 2, taken on the line III—III of FIG. 2.

The wall 21, which is circular in this case, includes an annular portion 21*a* extending radially from the shell 4 towards the axis L of the appliance and joined to a frusto-conical portion 21*b*, surmounted in turn by a ellipsoidal diffuser portion 21*c*, best seen in FIG. 3. The wall is at an angle of at least 90° to 120° relative to wall 21*c*. An upper disc portion 21*d* closes the central portion of the wall 21. Portions 21*a* and 21*b* of the wall 21 are formed in one piece by deforming a circular sheet, while the portions 21*c* and 21*d* are fitted to form the composite structure of the wall 21. All junctions between the various portions of the wall 21 are air-tight. In addition, the portion 21*c* of the wall has a plurality of elongate, slot-like openings 39 for letting the gas-air mixture into the combustion chamber to be ignited by an ignition element 25. The maximum distance between a group of flame openings 39 and the pilot burner 25, FIG. 3, should not exceed 300 mm.

As shown in the embodiment of FIGS., 1–3, the openings 39 are arranged in groups, like a crown, around the periphery of the ellipsoidal portion 21*c*, with the portion 21*c* itself constituting the head of a burner 22 into which the aforesaid gas-air mixture is fed through an induction duct 23. The frustoconical portion 21*b* of the wall 21 has a group of slots 50 having substantially the same shape and dimension as the openings 39.

A cavity 28 is defined beneath the wall 21 which is in fluid communication with the external environment through an opening 33 in the shell 4 and its bottom 10. The cavity 28 contains the end portions of the two ducts 37 and 38 for delivering gas to the nozzles 34 and 36 for ejecting gas to the burner 22 and to the ignition element 25, which in this case is a pilot burner. An induction duct 35, which is functionally equivalent to that described for the burner 22 is sealed to the portions 21*a* of the wall 21 and has a flame opening, (not illustrated), dimensionally similar to the openings 39. The thermocouple for the flame control is not illustrated. A valve 40 acts on both ducts 37 and 38 to regulate the flow of gas through them and is connected in turn to a thermometer 41 for measuring the temperature of the water in the tank 3.

In a preferred embodiment of the invention, in a wall 21 of a thickness of between 0.4 and 0.6 mm, the maximum width of the slots 50 and the openings 39 ranges between 0.4 and 0.5 mm, with circular holes the diameter is between 0.5 and 0.9. The spacing of adjacent openings, from center to center, is the same within a group between 1 and 1.5 mm. The distance between adjacent groups of slots 50 or openings 39 must be a maximum of around 15–20 mm for reasons which will be explained better later, with reference to the described operation of the appliance.

The values given above may vary, depending on the construction of the appliance (shape, dimensions, etc.). Generally, the ratio between the open surface (openings 39 with the slots 50) and its input must be between 200 and 500 $mm^2/kW$ to obtain an average transit speed, of air or mixtures, above 0.5 m/sec. The surface of the secondary air openings 50 is less than the total surface of said openings (39+50).

In so far as the heating of the fluid is concerned, operation of the embodiment of FIGS. 1–3, and of the variants which follow will be explained later. Operation is substantially the same as for conventional except for the aspects relating to the safety of the appliance in the event of volatile flammable substances being present in the surrounding environment which is absent prior art systems.

In order to heat the water in the tank 3, as a result of the venturi effect generated by the induction duct 23, the gas ejected from the nozzle 34 forms a gas-air mixture in the burner 22. This mixture passes out through the openings 39 and is ignited by contact with the ignition element 25, that is the flame of the pilot burner. The gas flow is regulated by the valve 40 in a known manner. This embodiment of the invention is constituted by an appliance with an atmospheric burner of a partial premixed type, that is in which the flame in the combustion chamber 20 burns both the aforesaid gas-air mixture generated by the venturi effect and combustion air drawn into the combustion chamber 20 through the apertures 50, as a result of the sub atmospheric pressure produced in the combustion chamber 20 by the buoyancy of exhausts or air heated by the hot water contained in the tank 3 exiting through the duct 5.

As far as the safety of the appliance is concerned, the avoidance of flash back in the event of volatile flammable substances filling its surrounding environment, two different cases might occur. The first occurs when the main burner is on, the second when only the pilot burner 25 is on.

In the first case, volatile flammable substances are drawn into the cavity 28 from outside the appliance as a result of the chimney effect created by the main burner. A portion of these substances joins the gas ejected from the nozzle 34 and passes through the openings 39 into the combustion chamber where it is burnt as explained above. In this case the combustion which occurs is not ideal for the burner as the volatile substances will have altered the optimal gas-air mixture. However, it will not affect the overall operation of the appliance.

In addition, a second portion of the volatile substance in the environment surrounding the appliance will be drawn into the chamber 20 through the slots 50 as explained above and will also be ignited by the flames coming from the openings 39 and the pilot burner because the reciprocal position of openings 39 and slots 50. In addition to these two portions being drawn inside the appliance, a third portion is drawn into the combustion chamber 20 by the pilot burner which is always burning and whose operation is the same as that of the main burner. The appliance of the invention is therefore clearly in conditions of maximum safety when the main burner is activated and carrying out its function of heating the fluid.

Turning now to the case in which volatile flammable substances fill the environment surrounding the appliance when the burner is not on and there are no flames at the openings 39. Only the pilot burner 25 is burning in the combustion chamber, but there is a natural draft in it and in the duct 5, created by the heat generated by the pilot burner and by the heat exchanged between the water in the tank 3 and the air in the duct 5. Because of the natural draft, volatile combustible substances, mixed with surrounding air, are drawn into the appliance and into its combustion chamber 20 via the only possible route (when the pilot is ignored), that is, through the slots 50 and the openings 39 in the annular portion 21*a* and the ellipsoidal portion 21*c* respectively of the wall 21. Since in either case, whether passing through the openings 39 or the slots 50 (see the particular relative positioning of these parts in FIG. 2) at least a fraction of the flow of volatile combustible substances drawn into the appliance will immediately touch the flame of the pilot burner 25. This fraction will be ignited by the pilot burner generating a flame which will spread through the combustion chamber to the groups of openings 39 and slots 50. This result, that is, the spread of the flame to all the openings and slots provided according to the invention, is encouraged by their arrangement in groups at intervals around the frustoconical portion 21*b* and the ellipsoidal portion 21*c* of the wall 21. This is made particularly effective in this embodiment by their dimensions as given earlier.

The key role of the dimensions of the slots 50 is that they prevent any flashback through the wall 21, which could spread outside the appliance with the unfortunate effects described at the beginning of this description. The slots 50 have substantially the same dimensions as those of the openings 39 which are already worked out so as to prevent this flashback phenomenon, since they act as outlets for the flames from the burner. An additional factor contributing to the safety of the appliance is represented by the fact that the mixture of air and volatile flammable substances is ignited immediately downstean of wall 21. This prevents the formation of dangerous explosive mixtures in the combustion chamber.

The relative position of the flame openings and secondary air openings have two different objectives. First, to bring in contact as soon as possible, a flammable mixture with flames of the main burner during on periods. Second, increase the air content of the primary mixture fuel air before the flame front to reduce, also for partially premixed burners, the $NO_x$ content in the exhausts. Variants of the embodiment of the invention described above are not excluded.

Figure 5:
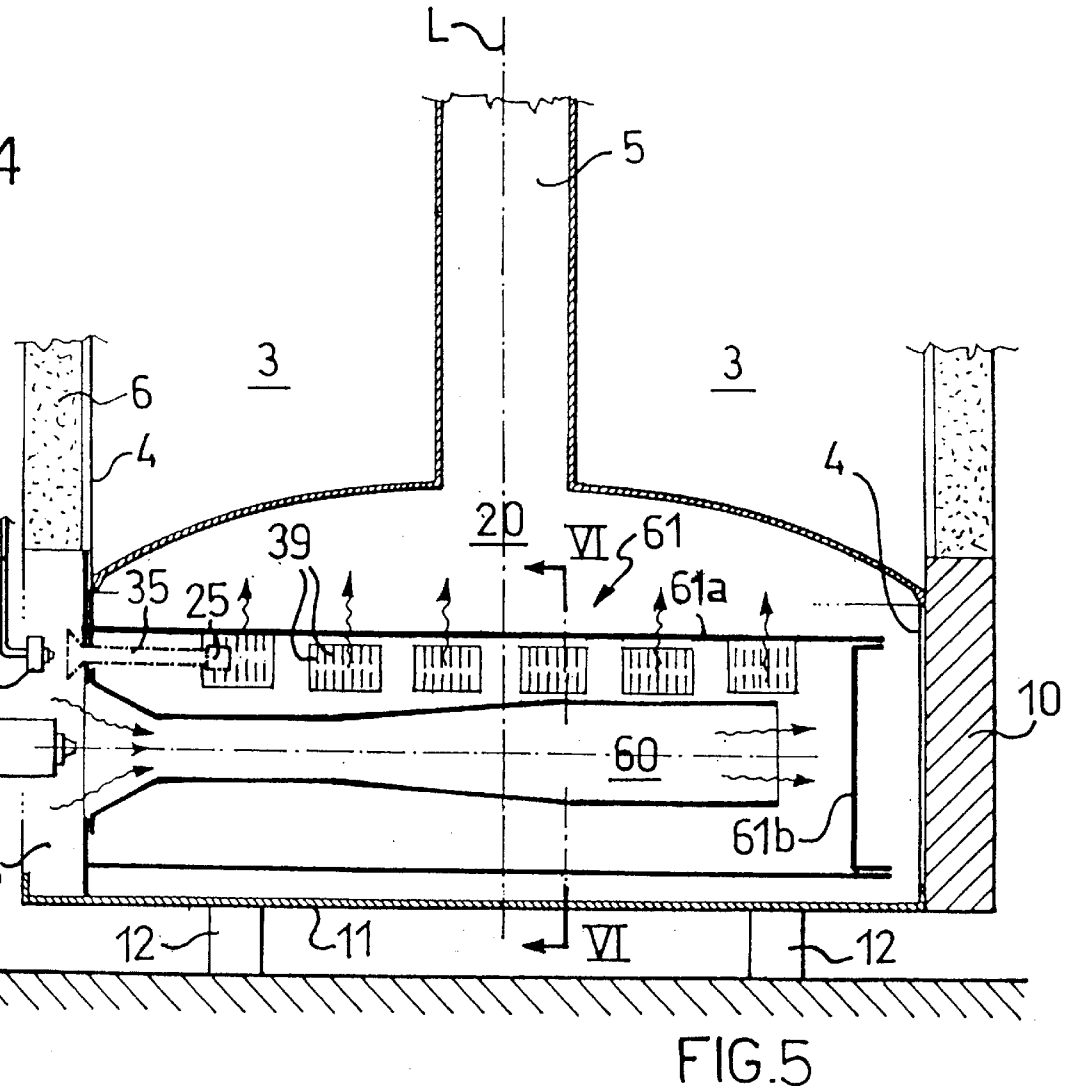
FIG. 5 is an enlargement of a detail of FIG. 4.
Figure 4:
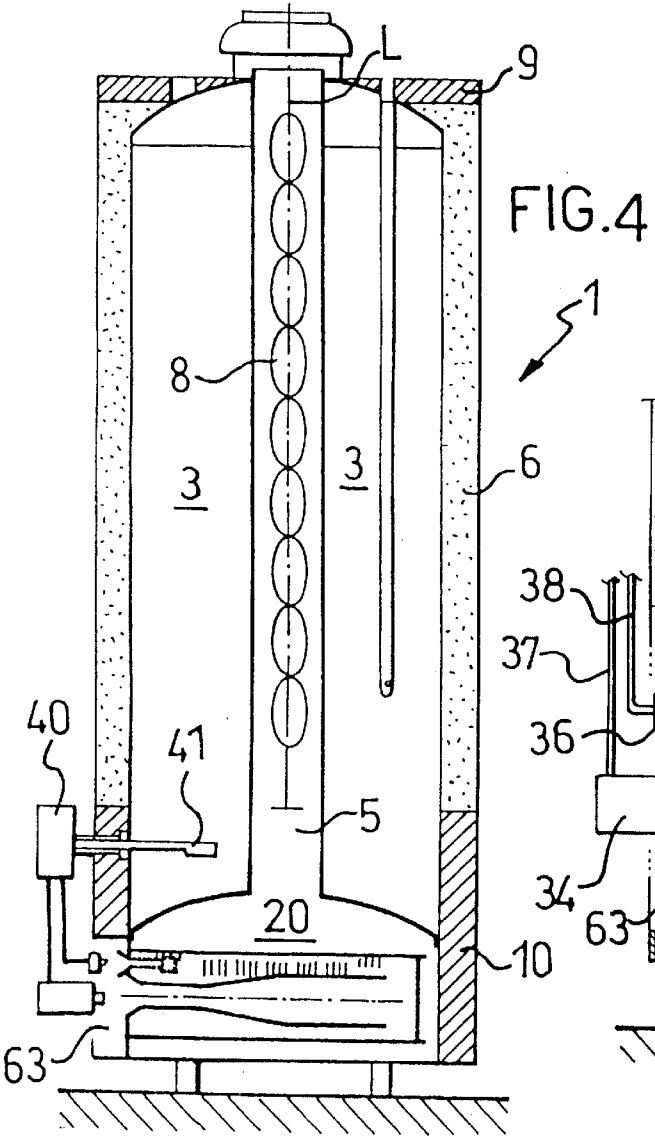
FIG. 4 is a longitudinal section of a variant of the appliance of the invention shown in the preceding Figures.
Figure 6:
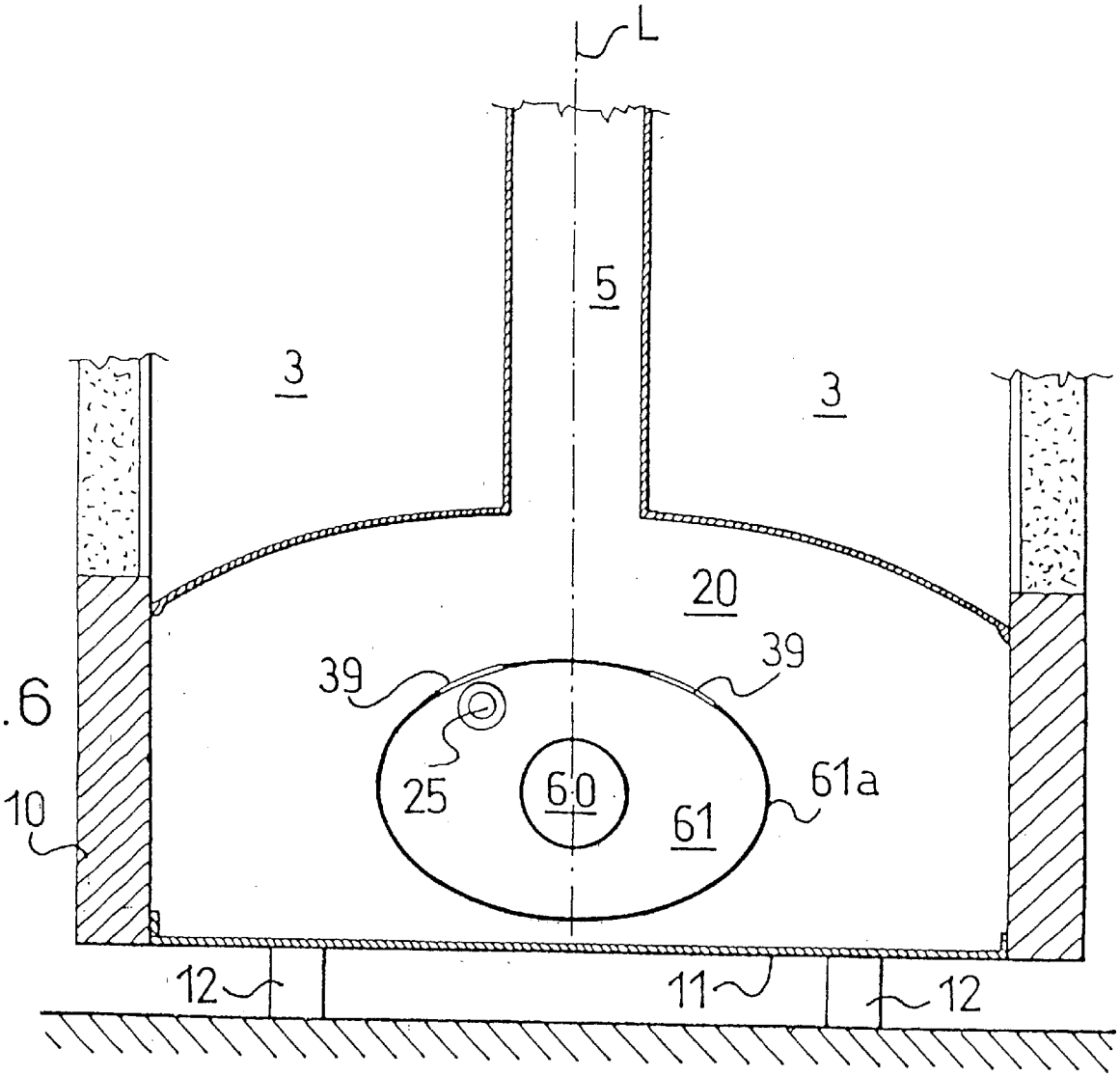
FIG. 6 is a section of the appliance of FIGS. 4 and 5, taken on the line VI—VI of FIG. 5.

One variant is illustrated in FIGS. 4–6 which show an appliance for heating fluids in which components which are structurally and functionally the same as those of the previous embodiment retain the same reference numbers. In the variant of FIGS. 4–6, the atmospheric burner is of a total premixed type. That is, the combustion chamber 20 burns only a gas-air mixture produced by a venturi-type tube 60, which is the only means of fluid communication between the combustion chamber and the outside environment through the flame openings on the housing 61 at one side and the aperture 63 in the bottom 10 of the appliance with its mouth sealed to the shell (see FIG. 4) on the other side. In fact, with this type of configuration, the flames in the combustion chamber 20 burn only the gas-air mixture produced by the venturi tube 60, without the need for an additional flow of combustion air into the chamber 20, as is required in the previous example. In this context, the pilot burner 25 is a copy of the main burner with reduced dimensions having a group of flame openings identical to the main burner.

Furthermore, the combustion chamber 20 is sealed from the base 11 and the burner housing 61 is formed by a wall 61*a*, the upper portion of this having a plurality of openings 39 in adjacent groups arranged in a ring which is substantially the same as in the previous embodiment, as shown in FIG. 3, and a flange 61*b*. The two parts, the base 11 and the body 61, have the same sealing function as the wall 21 in the previous embodiment. The venturi tube 60 receives gas from a nozzle 34 and a pilot burner 25 is arranged inside the housing 61, along with associated openings 39 and opening 35.

The operation of this variant will also only be discussed with regard to the safety of the appliance in the event of the presence of volatile combustible elements in the surrounding environment, since the heating of the water is carried out in almost the same way as described above. In this variant, the gas-air mixture produced in the venturi tube 60 expands in the housing 61 and flows from there into the combustion chamber 20 through the openings 39 on the upper portion of the wall 61*a*.

In the event of volatile flammable substances being present in the environment surrounding the appliance, there are two possibilities in this case. The first occurs while water is being heated in the tank and therefore flames of the main burner are present in the combustion chamber. The second occurs only when the pilot burner 25 is lit.

In the first case, the volatile substances merge with the gas ejected from the nozzle 34 and pass through the venturi tube 60 to the housing 61 and thence the combustion chamber 20 through the groups of openings 39. Openings 39 act as heads for the burner in this operating condition and the mixture of gas, air and volatile flammable substances is burnt to heat the water in the tank and, although this combustion is not ideal, for the reasons already explained earlier, the operation of the appliance is not significantly affected.

Should the volatile flammable substances be present, on the other hand, when the nozzle 34 is not delivering gas to the manifold 60 and there are thus no flames in the combustion chamber and appearing through the openings 39 but only the pilot burner 25 is lit, the substances are drawn into the combustion chamber by the "chimney effect" in the manner and for the same reasons explained earlier. They therefore enter the manifold 60, the housing 61 and thence the combustion chamber through the slots 39. At least a fraction of these substances will come into contact with the flame of the pilot burner and will be ignited in this case as well. The resulting flame will spread to all the groups of openings 39 arranged in a ring as described for the previous example, thus eliminating the flammable substances.

In the embodiment of FIGS. 4–6, the dimensions of the openings are again designed to prevent a flashback into the housing 61, both because they act as the head of the burner and in order to prevent the flame spreading to the flammable substances. The same numerical values as discussed in the previous example are relevant in this case too for the structure of the housing 61 and more particularly for the thickness of the wall 61*a* as well as the width of the openings 39 and the distances between adjacent groups of these.

The flame openings have such a total surface to obtain an average transit speed, of air or mixtures, above 0.5 m/sec. Flame stabilization is accomplished by the methods disclosed in U.S. Pat. No. 5,385,467, of the same inventor herein, by discharging the mixture from a pierced surface of substantially doughnut geometry comprising a slotted peripheral area and an essentially solid central area, bringing combustion to completion in a slender lamellar flame detached from the head of the burner so the temperature of the wall never reaches the value necessary to ignite any mixture on the other side (feed side).

Any mixture, air-fuel, air-fuel-flammable vapors, air-flammable vapors exiting in the combustion chamber, are immediately ignited from one pilot burner because the maximum distance between a group of flame openings 39 and the pilot burner 25 does not exceed 300 mm.

Another variant is described hereinafter, with references to FIGS. 7–10, which combines some of the structural details and operating principles of the previous two embodiments. Again, any components which are structurally or functionally the same as those of these first two embodiments are allocated the same reference numbers.

Figure 8:
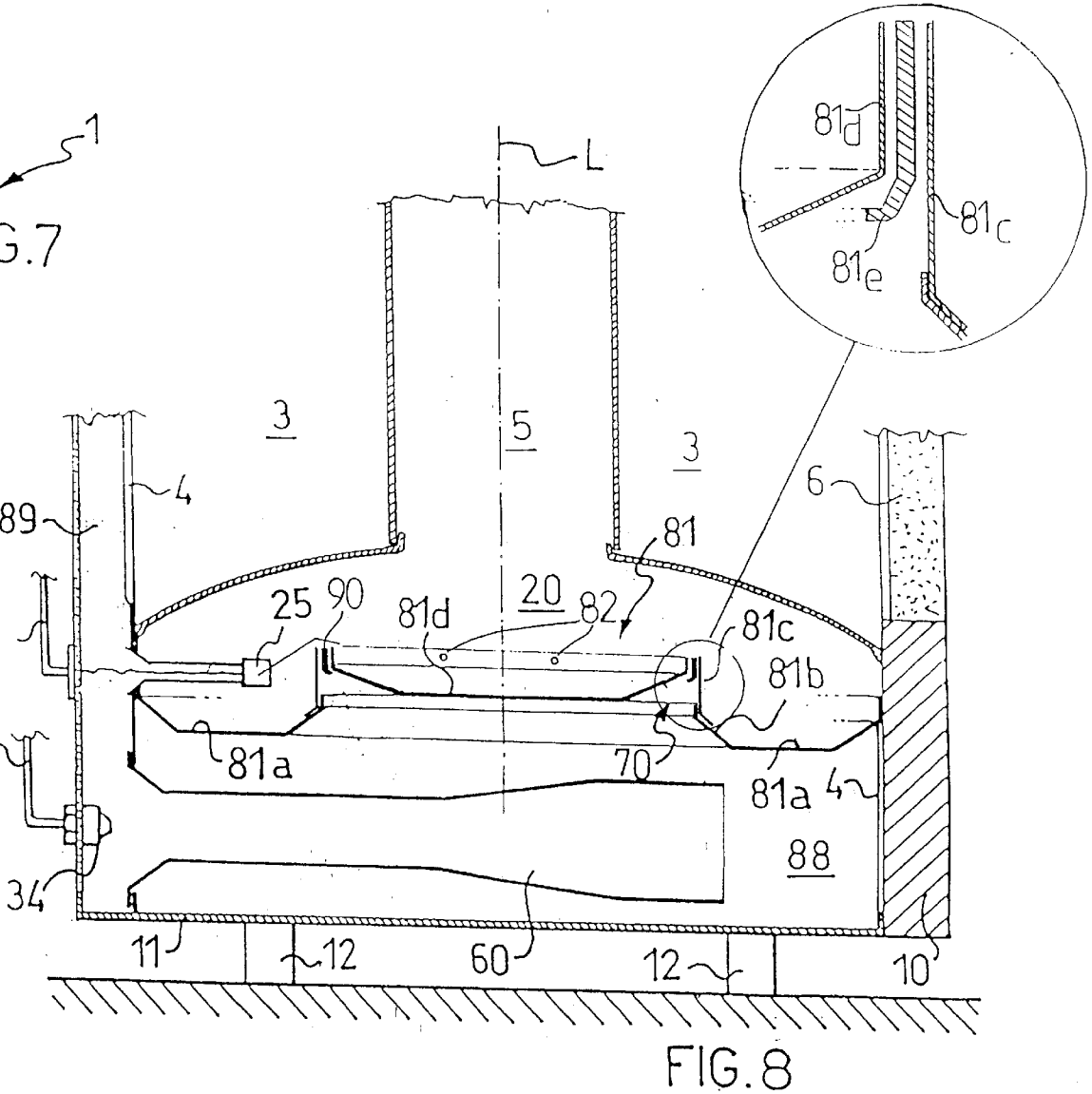
FIG. 8 is an enlargement of a detail of FIG. 7.
Figure 7:
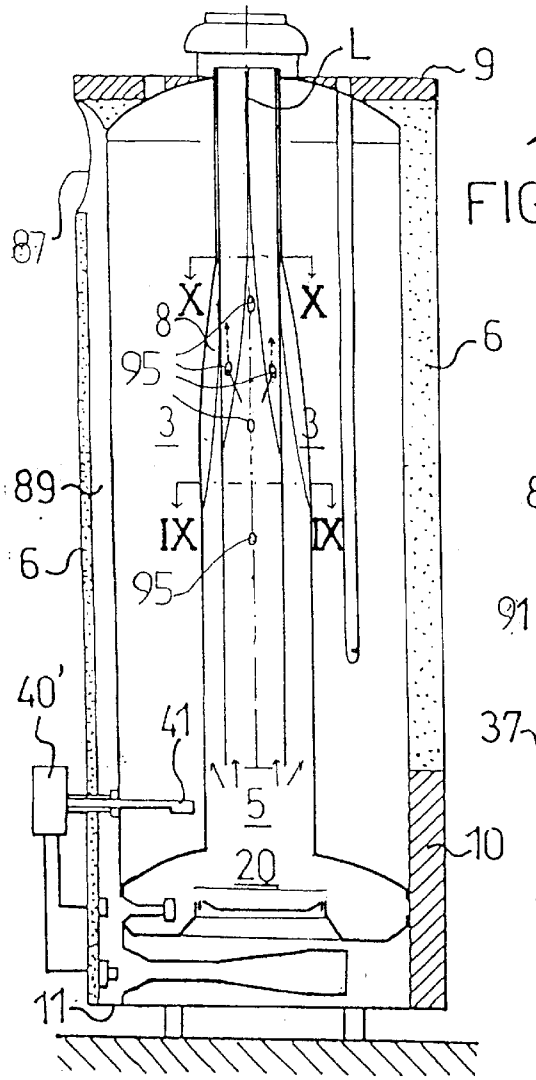
FIG. 7 is a longitudinal section of a variant of the appliance of the invention shown in the preceding Figures.
Figure 10:
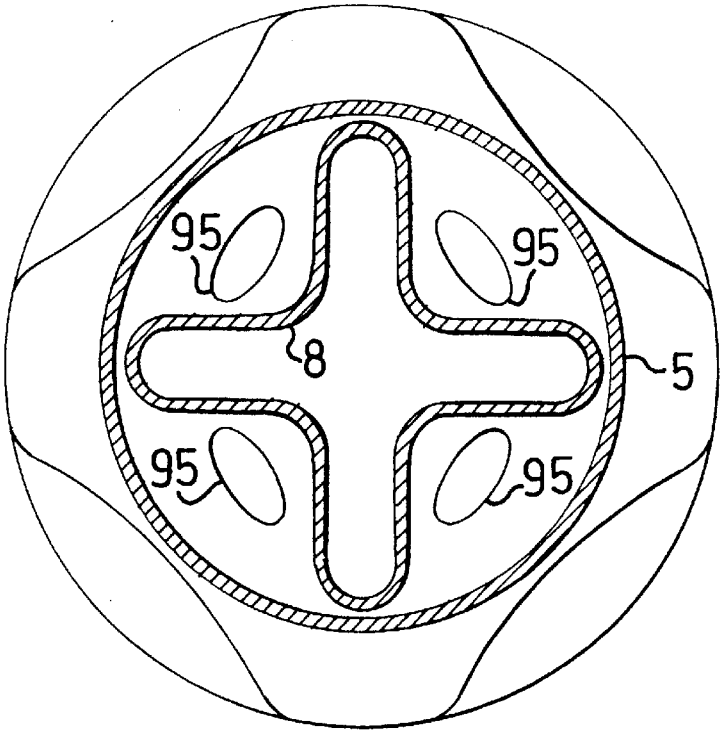
FIG. 10 is a section of the appliance of FIGS. 7 and 8, taken on the line IV—IV of FIG. 7.
Figure 9:
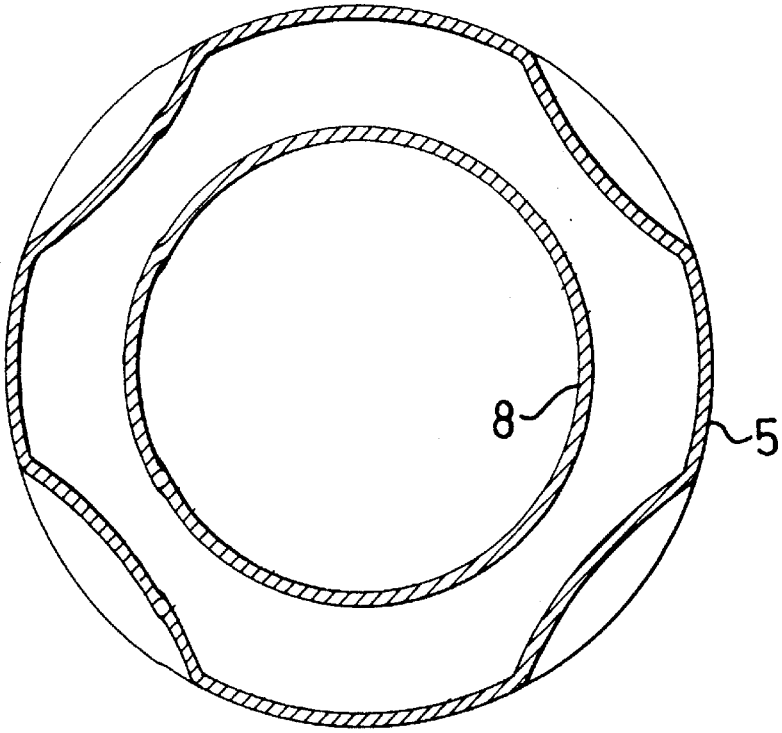
FIG. 9 is a section of the appliance of FIGS. 7 and 8, taken on the line V—V of FIG. 7.

A wall 81, with a composite profile similar to that of the wall 21 described earlier, includes an annular portion 81*a* which extends in a radial direction way from the bottom 10 of the appliance and is connected to a fruste-conical portion 81*b* which is surmounted in turn by an ellipsoidal portion 81*c*. Portion 81*c* is closed by an upper disc portion 81*d*. The connection between 81*c* and 81*d* is obtained through one intermediate ring 81*e*, 3 mm thick, forming, with the exception of the connection points 82, two rings form flame openings with a width of about 2 mm and a depth of about 15 mm. The connections between the portions 81*b* and ellipsoidal portion 81*c* are gas-tight, the annular portion 81*a* of the wall 81 has no openings or slots, meaning that the combustion chamber 20 is in fluid communication with a cavity 88 formed between the wall 81 and the base 11 of the appliance only through the above-mentioned openings. While FIG. 8 shows two annular openings, one or more, e.g. 2, 3, 4, 5 or more, are contemplated.

With respect to the variant of FIGS. 7–10, the appliance operates as a "fully-premixed" type burner in which the flames in the combustion chamber burn a gas-air mixture produced by the venturi effect in the tube 60, in a manner entirely similar to that seen for the second embodiment of the invention. In this case, the ignition element 25 is an electrode with two functions at the same time—spark ignition electrode and electrode to detect the ionization current for flame control. In this context it must be noted that the combustion air which is mixed in the venturi tube 60 is inducted by a duct 89 which extends along a generatrix of the appliance of the invention, incorporated in the insulating layer 6 thereof. The duct 89 extends from an inlet 87 adjacent the lid 9 of the appliance to the inlet of the venturi tube 60. The nozzle 34 is arranged inside this duct, frontally to the venturi tube 60.

In this embodiment when only one burner goes off, the air, heated in the same way as in the duct 5' and in the duct 89, because the contact with the hot water tank wall, rapidly reaches the same temperature balancing the buoyancy into the two sides of a U formed duct 89+60+88+20+5'. Therefore, any air flow is stopped thus preventing, between heating periods, the induction of flammable vapors and therefore the fire risk. During the heating periods, a spark between the electrode 90 and the flame opening lips 81*c* or 81*e* or 81*d* ignites the mixture exiting from the same openings with or without flammable substances. The flames remain under ionization current control carried out by the same electrode 90 in electrical contact through an insulated cable 91 to the gas control 40 in this embodiment incorporating a battery driven electronic ignition and flame control.

To reduce the flow resistance of air, air-gas mixtures and exhausts in this embodiment, a new design of the exhaust duct 5 and of the baffle 8, designated 5' and 8' is provided, without changing the diameter of the exhaust pipe connection. This design improves the heat recovery efficiency of the appliance whereby standby losses are minimized as a result of the U formed duct 89+60+88+20+5'.

The exhaust duct 5' has a reduced diameter on the top side and one enlarged on the bottom side. The two sections are connected with a frustoconical section with four nail formed impressions. The total surface of the duct is 5' almost the same as that of a pipe of the same length and the diameter of the bottom side of said duct 5'.

Inside and concentric to the duct 5' is placed a formed pipe baffle 8' which has a bottom cylindrical portion, a top portion with cross formed section completely closed on the summit. An intermediate portion with four nail formed impressions, corresponding to the similar impressions on the duct 5', perforated with holes or slots 95 to permit the flow of exhausts exiting from inside the pipe baffle 8' to the duct 5'.

The very hot exhausts exiting the combustion chamber go inside the duct 5' then are divided in two parts, one enters the pipe baffle 8' exchanging heat only with the internal surface of the pipe 8' which becomes very hot, radiating strongly to the surface of the duct 5' kept at low temperature because the contact with the water. The other enter between the pipe 8' and the duct 5'. At about two thirds of the duct 5' height, the two flows join together creating a single turbulent flow improving the heat exchange of the top portion of the duct 5'.

This heat exchange design of the duct 5' is enlarged up to 50% compared with a cylindrical duct having a diameter equal to the diameter of the top-exit of the duct 5' and the same length without tangibly reducing the capacity of the water tank.

In addition, with reference to the ignition element, each of the embodiments of the invention could have a plurality of ignition elements. It has been verified that the spreading of the flames to all the openings and/or slots in the appliance, and thus the elimination of volatile substances, is especially effective when the opening or the group of openings is distant not more than 300 mm from the ignition element. This means that it is advisable to provide an additional ignition element when the distance exceeds this value. In general, the appliance of the invention proved to be especially effective when the volatile substances were ignited at all the openings 39 and slots 50, if present, in a maximum of 5 seconds.

Although the foregoing invention has been described in some detail by way of illustration and example for purposes of clarity of understanding, it will be obvious to those skilled in the art that certain changes and modifications may be practiced without departing from the spirit and scope thereof as described in the specification and as defined in the appended claims.

I claim:

1. A gas-fired, natural draft, convective heat transfer apparatus comprising:

a chamber for containing a fluid to be heated;

a sealed combustion chamber having at least one exhaust duct extending upwardly therefrom through said chamber for containing a fluid to be heated; and at least one premix burner within said combustion chamber, said burner communicating with an environmental supply of an oxygen containing gas, and a fuel supply means, and having a wall defining a plurality of first flame openings and optionally, a plurality of second openings, said first flame openings and said optional second openings separating an interior of said combustion chamber from the environment so as to limit the fluid communication therebetween to said first flame openings and said optional second openings, each of said first flame openings and each of said optional second openings having a width/wall thickness ratio and spacing that avoids flash back and spacing that insures cross ignition, said first flame openings, plus said optional secondary air openings, having sufficient surface area to obtain flames detached from said burner wall.

2. The apparatus according to claim 1, wherein each of said plurality of first flame openings and said plurality of optional second openings has a cross-sectional area, wherein a ratio defined by a sum of said cross-sectional areas to burner energy input is between 200 and 500 $mm^2$/Kw.

3. The apparatus according to claim 1, wherein both first flame openings and second openings are present and a total cross-sectional flow area of said second openings is less than a total cross-sectional flow area of all said openings.

4. The apparatus according to claim 3, wherein a wall of said burner includes an inclined portion at a angle of at least about 90° to a 120° relative to said wall housing said first flame openings, said inclined portion housing said optional openings.

5. The apparatus according to claim 1, wherein said fuel supply means aspirates, as the environment supply of oxygen, a primary air stream from the environment to form a hyperstoichiometric combustible air-fuel mixture for delivery to a plenum chamber within said at least one premix burner.

6. The apparatus according to claim 1, further comprising an ignition means spaced downstream of said plurality of first flame openings for igniting an air-fuel mixture to generate flames.

7. The appliance according to claim 6, wherein said ignition means comprise a plurality of ignition elements.

8. The apparatus according to claim 7, wherein at least one ignition element is a pilot burner functionally identical to said at least one atmospheric burner.

9. The apparatus according to claim 8, wherein the pilot burner is incorporated into said at least one atmospheric burner.

10. The apparatus according to claim 1, wherein exhaust duct dimension and number and cross-sectional flow area of said openings is selected so that average transit speed of air or air-fuel through said openings is higher that 0.5 m/s.

11. The apparatus according to claim 1, wherein each of said flame openings and said optional openings are elongated slots having a width between 0.4 and 0.5 mm and a depth between 0.4 and 0.6 mm.

12. The apparatus according to claim 1, wherein said openings are circular in cross-section having a diameter between 0.4 and 0.9 mm and a depth between 0.4 and 0.6 mm.

13. The apparatus according to claim 1, wherein adjacent flame openings and adjacent optional opening are spaced between 1.0 and 1.5 mm from respective centers points thereof.

14. The apparatus according to claim 1, wherein said openings are arranged in groups spaced no more than 20 mm from each other, with center distanced between two adjacent openings in a group being between 1.0 and 1.5 mm.

15. The apparatus according to claim 14, wherein said groups are arranged at a maximum distance of 20 mm from each other.

16. The apparatus according to claim 1, wherein the burner and/or the wall is a sheet metal and the flame openings are substantially parallel slots.

17. The apparatus according to claim 1, wherein said openings are slots that have bent lips with a width/depth ratio between ⅕ and 1/10.

18. The apparatus according to claim 17, wherein a center distance between two adjacent flame openings or optional openings is about 6 mm or less.

19. The apparatus according to claim 1, wherein said at least one exhaust duct includes a top portion with a reduced cross-sectional flow section, a bottom portion with an increased cross-sectional flow area, and a frustoconical portion connecting the top and the bottom portion to one another.

20. The apparatus according to claim 19, wherein said bottom portion and said frustoconical portion are corrugated walls so that a total surface of the at least one exhaust duct is substantially the same as a surface of a pipe having a cross-sectional flow area equivalent to the cross-sectional flow area of said bottom portion.

21. The apparatus according to claim 1, wherein said at least one exhaust duct is a formed pipe baffle which is arranged inside of and concentrically with said duct, and is closed at its top end and is provided with perforations.

22. The apparatus according to claim 1, further including a gas control unit which includes an electronic ignition and control device, said ignition means comprising an electrode to detect ionization current for flame control.

23. The apparatus according to claim 1, wherein said burner has and elliptical cross-section and said flame openings are arranged along an elliptical surface.

24. The apparatus according to claim 1, wherein said at least one premix burner has a stabilizing means.

25. The apparatus according to claim 1, wherein said stabilizing means includes a radially outwardly extending groove or channel in an upper portion of said wall.

26. The apparatus according to claim 1, wherein said flame openings include at least one annular opening in an upper wall of said at least one premix burner.

27. The apparatus according to claim 1, further including an air inlet duct having a primary air inlet opening at a upper-end thereof and an outlet at a lower-end thereof, thereby forming with said exhaust duct a U-shaped flow channel.

28. A method of convectively heating a fluid comprising:

contacting a fluid to be heated with an exterior surface of a sealed combustion chamber and at least one exhaust duct;

supplying air and fuel gas to said combustion chamber and exhausting products of combustion through said at least one exhaust duct under natural draft conditions;

providing at least one premix burner within said combustion chamber;

preventing flash back from said burner by providing a detached flame from a plurality of first flame openings and optionally, a plurality of second openings in a wall of said burner, as a result of said natural draft, and a width/wall thickness ratio and spacing of said openings that insures cross ignition of said air and said fuel, and volatile components, downstream of said openings and direction of said air and fuel supply.

29. The method according to claim 28, wherein each of said plurality of first flame openings and said plurality of optional second openings has a cross-sectional area, wherein a ratio defined by a sum of said cross-sectional areas to burner energy input is between 200 and 500 $mm^2$/Kw.

30. The method according to claim 28, wherein both first flame openings and second openings are present and a total cross-sectional flow area of said second openings is less than the total cross-sectional flow area of all said openings.

31. The method according to claim 28, wherein said fuel aspirates said air as a primary air stream for delivery into a plenum chamber within said at least one premix burner.

32. The method according to claim 28, further comprising the step of igniting said air and fuel which emanates from said opening with an ignition means spaced downstream of said plurality of first flame openings.

33. The method according to claim 28, wherein said air or air and fuel is passed through said openings at an average transit speed greater that 0.5 m/sec.

34. The method according to claim 28, wherein cross-ignition is completed within about 5 seconds.

35. The method according to claim 28, wherein said air and fuel supply includes no volatile vapors, and cross-ignition occurs within about 5 seconds.

* * * * *